US006526946B1

(12) United States Patent
Kanno

(10) Patent No.: US 6,526,946 B1
(45) Date of Patent: Mar. 4, 2003

(54) FUEL INJECTION SYSTEM FOR MARINE PROPULSION DEVICE

(75) Inventor: Isao Kanno, Shizuoka (JP)

(73) Assignee: Shansin Kogyo Kabushiki Kaisha, Shizuoka (JP)

( * ) Notice: Subject to any disclaimer, the term of this patent is extended or adjusted under 35 U.S.C. 154(b) by 0 days.

(21) Appl. No.: 09/704,470

(22) Filed: Nov. 1, 2000

(30) Foreign Application Priority Data

Nov. 1, 1999 (JP) ..... 11-310796

(51) Int. Cl.[7] ..... F01D 41/12
(52) U.S. Cl. ..... 123/493; 477/111
(58) Field of Search ..... 123/325, 339.19, 123/339.11, 349, 350, 352, 493, 73 A, 73 AD; 701/103, 104; 477/109, 111

(56) References Cited

U.S. PATENT DOCUMENTS

| | | | | |
|---|---|---|---|---|
| 4,305,365 A | * | 12/1981 | Iizuka et al. | 123/325 |
| 4,966,111 A | * | 10/1990 | Fujimoto et al. | 123/399 |
| 4,967,700 A | * | 11/1990 | Torigai | 123/73 AD |
| 5,081,975 A | * | 1/1992 | Maebashi | 123/493 |
| 5,140,964 A | | 8/1992 | Torigai | 123/492 |
| 5,146,899 A | | 9/1992 | Tanaka et al. | 123/494 |
| 5,243,945 A | | 9/1993 | Katoh et al. | 123/533 |
| 5,251,582 A | | 10/1993 | Mochizuki | 123/73 A |
| 5,269,243 A | | 12/1993 | Mochizuki | 123/41.55 |
| 5,322,044 A | | 6/1994 | Maebashi | 123/305 |
| 5,448,974 A | | 9/1995 | Toda | 123/400 |
| 5,450,828 A | | 9/1995 | Sakamoto et al. | 123/339.11 |
| 5,462,031 A | | 10/1995 | Kai | 123/478 |
| 5,522,360 A | | 6/1996 | Suzuki et al. | 123/329 |
| 5,626,120 A | | 5/1997 | Akatsuka | 123/479 |
| 5,655,500 A | | 8/1997 | Kato | 123/336 |
| 5,665,025 A | | 9/1997 | Katoh | 477/107 |
| 5,687,700 A | | 11/1997 | Kato | 123/688 |
| 5,794,605 A | | 8/1998 | Kato | 123/688 |
| 5,937,825 A | | 8/1999 | Motose | 123/406.13 |
| 5,941,223 A | | 8/1999 | Kato | 123/679 |

OTHER PUBLICATIONS

Co–pending application, Serial. No. 09/708,900, filed on Nov. 8, 2000, entitled Marine Engine Control System, in the name of Isao Kanno, and assigned to Sanshin Kogyo Kabushiki Kaisha.

Co–pendgin application Serial. No. 09/704,015, filed on Nov. 1, 2000, entitled Fuel Injection Control System for Marine Engines, in the name Isao Kanno, and assigned to Sanshin Kogyo Kabushiki Kaisha.

* cited by examiner

*Primary Examiner*—Willis R. Wolfe
(74) *Attorney, Agent, or Firm*—Knobbe, Martens, Olson & Bear, LLP

(57) ABSTRACT

An outboard motor comprises an engine mounted within an engine compartment. The engine comprises an induction system having a throttle valve that controls the flow of air through the induction system. The engine also comprises a fuel injection system that controls the amount of fuel supplied to the engine. The amount of fuel injected into the engine is substantially reduced if the throttle valve rapidly close and a transmission of the outboard motor is engaged. If the transmission of the outboard motor is disengaged when the throttle valve rapidly closes, the amount of fuel injected into the engine is reduced to a lesser degree.

28 Claims, 10 Drawing Sheets

FUEL INJECTION SYSTEM FOR MARINE PROPULSION DEVICE

PRIORITY INFORMATION

This application is based on and claims priority to Japanese Patent Application No. 11-310796, filed Nov. 1, 1999, the entire contents of which is hereby expressly incorporated by reference.

BACKGROUND OF THE INVENTION

1. Field of the Invention

The present invention generally relates to fuel injection controls for internal combustion engines used in marine applications. More specifically, the present invention relates to such systems in which fuel injection amounts are adjusted based on an operative position of an associated transmission as well as a throttle position.

2. Related Art

Outboard motors are used to power boats and other watercraft. Outboard motors typically include an internal combustion engine that is surrounded by a protective cowling. The engine of the outboard motor is coupled though a driveshaft to a propulsion device, such as, for example, a propeller. The propulsion device typically lies in the body of water in which the watercraft floats and drives the watercraft in a forward or reverse direction.

The outboard motor typically includes an intake system for supplying air to the engine. The intake system typically includes a throttle control valve, which controls the amount of air flowing through the induction system and into the engine. When the throttle valve is closed, the air flow rate is minimized and when the throttle valve is opened, the flow rate through the induction system can be controlled. The throttle valve usually is coupled to a throttle valve actuator, which is controlled by an operator of the watercraft.

Outboard motors typically also include a fuel injection system for supplying fuel to the engine. Fuel injection systems often include fuel injectors that either inject fuel directly into an air induction device or into a combustion chamber of the engine. The amount of fuel injected through the fuel injectors is determined by a control system, which usually includes an electronic control unit (ECU). Typically, the ECU determines the amount of fuel to be injected through the fuel injectors based upon various engine and ambient conditions, such as, for example, the position of the throttle valve.

SUMMARY OF THE INVENTION

Due to the environment in which outboard motors operate, there are some operating conditions that are unique to outboard motors. For example, when the operator releases the throttle valve actuator, the throttle valve rapidly closes (i.e., the throttle valve closes under the biasing force of a spring, as the opening force provided by the operator controlled actuator is removed). In engines used in land vehicles, this causes the engine speed to decrease rapidly. However, in an outboard motor that is attached to a moving watercraft, when the transmission is in forward or reverse, the advancing force of the watercraft tends to drive the propeller, which, in turn, drives the engine. That is, the water surrounding the propeller rotates the propeller, which, in turn, rotates the crankshaft. The engine speed, therefore, does not decrease rapidly. This can cause several problems. For example, because the engine speed does not decrease rapidly, the watercraft is undesirably unresponsive to changes in operator demand. Moreover, excess fuel can pass into the exhaust system which can cause backfiring.

Accordingly, an arrangement of the outboard motor is desired in which the performance of the outboard motor when the throttle valve rapidly closes is improved. Thus, a fuel injection control system is provided in which the amount of fuel injected through the fuel injectors is substantially reduced when the throttle valve rapidly closes and the engine is in forward or reverse drive. However, when the engine is disengaged or in neutral, the fuel injection system is arranged such that the amount of fuel is reduced to a lesser degree as compared to when the engine is in forward or reverse drive.

Accordingly, one aspect of the present invention involves an engine for a watercraft. The engine comprises a cylinder body, at least one cylinder bore being formed in said cylinder body, and a piston being mounted for reciprocation within the cylinder bore. A cylinder head is disposed over a first end of the cylinder bore. A crankcase member is disposed over a second end of the cylinder bore. An output shaft is disposed at least partially within a crankcase chamber that is at least partially defined by the crankcase member. The output shaft powers an output device through a shiftable transmission. A transmission sensor is capable of detecting whether the output device is engaged or disengaged with the output shaft. A combustion chamber is defined at least partially within the cylinder bore between the cylinder head and the piston. An intake conduit communicates with the combustion chamber. A throttle valve is disposed within the intake conduit. The engine further including a throttle valve sensor that is capable of sensing a position of said throttle valve. A fuel injection system includes a fuel injector that supplies fuel to the combustion chamber. The fuel injector includes an actuator to regulate an amount fuel that is injected by the fuel injector. A controller electrically communicates with the actuator for the fuel injector, the transmission sensor and the throttle valve sensor. The controller is adapted to substantially reduce the amount of fuel injected by the fuel injector to a second amount of fuel when the throttle valve is rapidly closed and the output device is engaged.

Another aspect of the present invention involves an engine for a watercraft. The engine comprises a cylinder body, at least one cylinder bore being formed in said cylinder body, and a piston being mounted for reciprocation within the cylinder bore. A cylinder head is disposed over a first end of the cylinder bore. A crankcase member is disposed over a second end of the cylinder bore. An output shaft is disposed at least partially within a crankcase chamber that is at least partially defined by the crankcase member. The output shaft powers an output device through a shiftable transmission. A transmission sensor is capable of detecting whether the output device is engaged or disengaged with the output shaft. A combustion chamber is defined at least partially within the cylinder bore between the cylinder head and the piston. An intake conduit communicates with the combustion chamber. A throttle valve is disposed within the intake conduit. The engine further including a throttle valve sensor that is capable of sensing a position of said throttle valve. A fuel injection system includes a fuel injector that supplies fuel to the combustion chamber. The fuel injector includes an actuator to regulate an amount fuel that is injected by the fuel injector. A controller electrically communicates with the actuator for the fuel injector, the transmission sensor and the throttle valve sensor. The controller is adapted to reduce the amount of fuel injected by the fuel injector to a first amount when the throttle valve is rapidly closed and the output device is engaged and to reduce the amount of fuel injected by the fuel injector to a second amount when the output device is disengaged.

Yet another aspect of the present invention involves a method of controlling an amount of fuel injected into an engine when a throttle valve is rapidly closed. The method comprises detecting a throttle valve angle, determining if the valve is substantially closed and determining whether a transmission of the engine is engaged or disengaged. The method further comprises sensing the engine speed and comparing the engine speed to a first specified value, reducing an amount of fuel injected into the engine by a first amount if the engine speed is greater than the second specified value and the transmission is engaged, reducing the amount of fuel injected into the engine by a second amount if the transmission is disengaged.

A further aspect of the present invention involves a method of controlling an amount of fuel injected into an engine when a throttle valve is rapidly closed. The method comprises, detecting a throttle valve angle, determining if a transmission of the engine is in a first condition or a second condition, and sensing an engine speed.

BRIEF DESCRIPTION OF THE DRAWINGS

These and other features, aspects and advantages of the present invention will now be described with reference to the drawings of a preferred embodiment which is intended to illustrate and not to limit the invention. The drawings comprise 10 figures.

DETAILED DESCRIPTION OF THE PREFERRED EMBODIMENTS OF THE INVENTION

Figure 1:
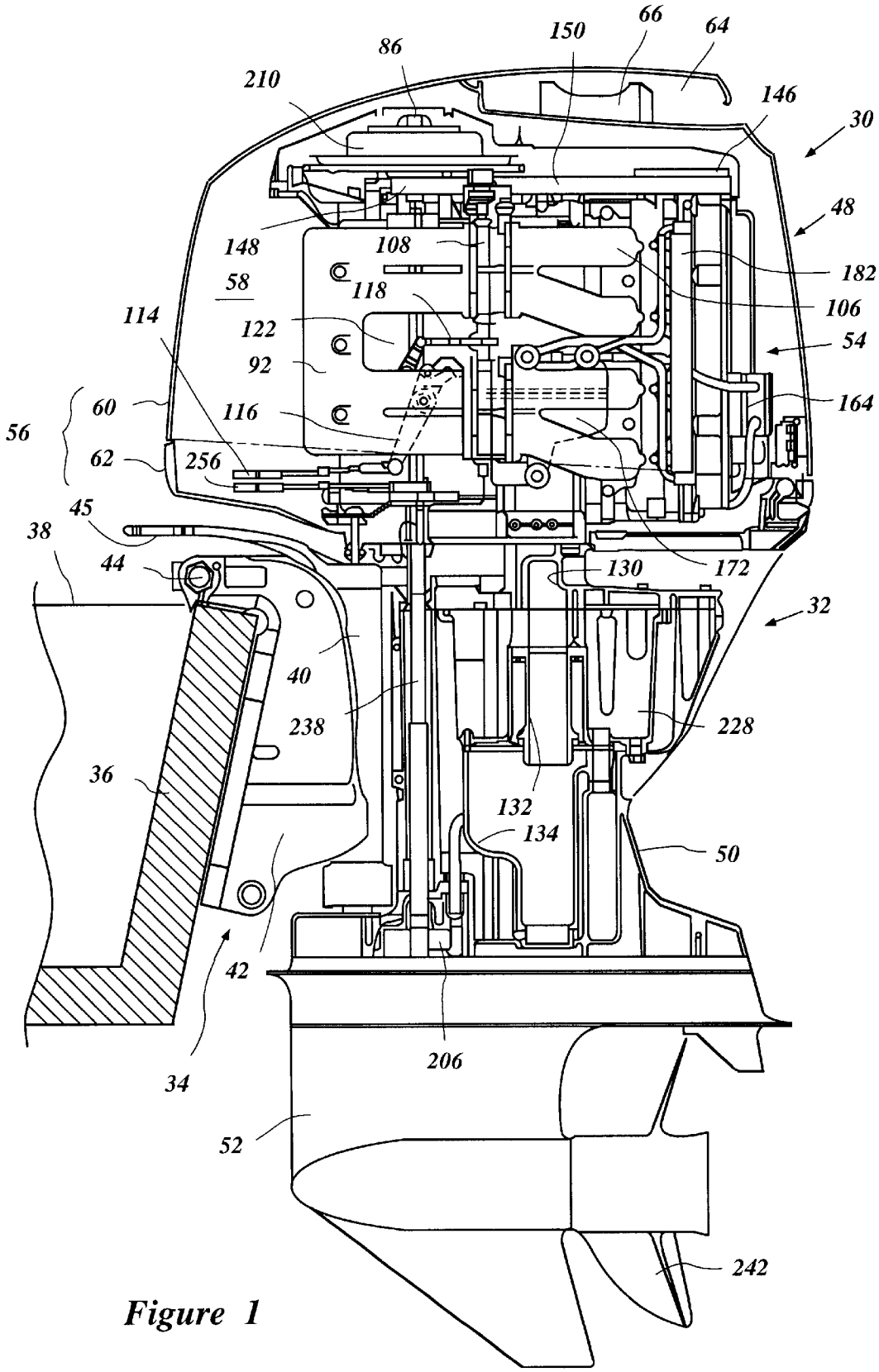
FIG. 1 is a side elevation wire frame view of an outboard motor that has a fuel injection control system configured in accordance with certain features, aspects and advantages of the present invention. An associated watercraft is partially illustrated in this figure as well.

With reference to FIGS. 1–5, an overall construction of an outboard motor 30, which employs a control system arranged and configured in accordance with certain features, aspects and advantages of the present invention, will be described. Although the present invention is shown in the context of an outboard motor engine, various features, aspects and advantages of the present invention also can be employed with engines used in other types of marine drives (e.g., a stem drive unit and in-board/outboard drives) and also, for example, with engines used in land vehicles (i.e., motorcycles, snowmobiles and all terrain vehicles) and stationary engines (i.e., generators).

In the illustrated arrangement, the outboard motor 30 comprises a drive unit 32 and a bracket assembly 34. The bracket assembly 34 supports the drive unit 32 on a transom 36 of an associated watercraft 38. The drive unit 32 preferably is disposed such that a marine propulsion device is placed in a submerged position with the watercraft 38 resting on the surface of a body of water. The bracket assembly 34 preferably comprises a swivel bracket 40, a clamping bracket 42, a steering shaft and a pivot pin 44.

As is known, the steering shaft typically extends through the swivel bracket 40 and is affixed to the drive unit 32. The steering shaft is journaled for steering movement about a generally vertically extending steering axis, which is defined within the swivel bracket 40.

The clamping bracket 34 preferably includes a pair of bracket arms that are spaced apart from each other and that are affixed to the watercraft transom 36. The pivot pin 44 completes a hinge coupling between the swivel bracket 40 and the clamping bracket 42. The pivot pin 44 extends through the bracket arms so that the clamping bracket 42 supports the swivel bracket 40 for pivotal movement about a generally horizontally extending tilt axis, which is defined by the pivot pin 44. The illustrated drive unit 32 thus can be tilted or trimmed about the pivot pin 44.

As used through this description, the terms "forward," "forwardly" and "front" mean at or to the side where the bracket assembly 36 is located, and the terms "rear," "reverse," "backwardly" and "rearwardly" mean at or to the opposite side of the front side, unless indicated otherwise or otherwise readily apparent from the context use.

A hydraulic tilt and trim adjustment system preferably extends between the swivel bracket 40 and the clamping bracket 42 to raise or lower the swivel bracket 40 and the drive unit 32 relative to the clamping bracket 34. In other arrangements, the outboard motor 30 can have a manually operated system for raising and lowering the drive unit 32.

The illustrated drive unit 32 includes a power head 48, a driveshaft housing 50 and a lower unit 52. The power head 48 is disposed atop the drive unit 32 and includes an internal combustion engine 54, which is positioned within a protective cowling 56. The protective cowling 56 in the illustrated arrangement defines a generally closed engine compartment 58. The protective cowling 56 preferably comprises a top cowling member 60 and a bottom cowling member 62. The top cowling member 60 can be detachably affixed to the bottom cowling 62 so that the operator can access the engine 54 for maintenance or other purposes.

The top cowling 60 preferably comprises a pair of air intake compartments 64 at both rear sides thereof. Each compartment 64 has an air duct 66 that extends generally vertically in the compartment 64. The air intake compartments 64 communicate with the closed cavity 58 through the air ducts 66 so that an ambient air can be introduced into the cavity 58 and to the engine 54 for combustion.

The engine 54 preferably operates on a four-stroke combustion principle. The illustrated engine 54 comprises a cylinder block 70 that defines four cylinder bores 72. The cylinder bores 72 are generally horizontally extending and are vertically spaced from one another. This type of engine, however, is exemplary of an engine on which various features, aspects and advantages of the present invention can be used. Engines having other number of cylinder bores, having other cylinder arrangements and operating on other combustion principles (e.g., two-stroke crankcase combustion or rotary) all can use at least some of the features, aspects or advantages described herein.

A piston 76 can reciprocate in each cylinder bore 72. In the illustrated arrangement, a cylinder head assembly 78 is affixed to one end of the cylinder block 70 and, together with the pistons 76 and the cylinder bores 72, defines four combustion chambers 80. A crankcase member preferably closes the other end of the cylinder block 70. Together, the cylinder block 70 and the crankcase member at least partially define a crankcase chamber 84. A crankshaft 86 extends generally vertically through the crankcase chamber 84. The crankshaft 86 preferably is connected to the pistons 76 by connecting rods 88 and is rotated by the reciprocal movement of the pistons 76. In the illustrated arrangement, the crankcase member 82 is located at the most forward position with the cylinder block 70 and the cylinder head assembly 78 extends rearward from the crankcase member 82. These components preferably are mounted in seriatim.

The engine 54 includes an air induction system 88 through which air is introduced into the combustion chambers 80. The induction system 88 preferably includes a plenum chamber 92, four air intake passages 94 and eight intake ports 96. As will be recognized, the number of intake passages and ports can vary. The intake ports 96 are defined in the cylinder head assembly 78. In the illustrated arrangement, two of the intake ports 96 are associated with a single intake passage 94 and both of the intake ports 96 open into a single combustion chamber 80.

The intake ports 96 are repeatedly opened and closed by intake valves 98. When intake ports 96 are opened, the respective intake passages 94 communicate with the associated combustion chambers 80.

The plenum chamber 92 functions as an intake silencer and/or a coordinator of air charges. In the illustrated arrangement, a plenum chamber member 100 defines the plenum chamber 92 and is mounted on the port side of the crankcase member 82. The plenum chamber member 92 preferably has an air inlet opening (not shown) that opens to the closed cavity 58. The illustrated intake passages 94 extend rearwardly from the plenum chamber member 100 along the cylinder block 70 on the port side and then bend toward the intake ports 96. Air is taken into the plenum chamber 92 from the cavity or engine compartment through the inlet opening. The air then is introduced into the combustion chambers 80 through the intake passages 94 and the intake ports 80.

The illustrated intake passages 94 are defined by intake ducts 104, which are preferably formed with the plenum chamber member 100, intake manifolds 106 connected to the associated intake ports 96 and throttle bodies 108 interposed between the intake ducts 104 and the intake manifolds 106. In the illustrated arrangement, the respective throttle bodies 108 support butterfly-type throttle valves 110 in a manner that allows pivotal movement of the valves 110 about axes defined by valve shafts that extend generally vertically. The valve shafts preferably are linked together to form a single valve shaft assembly 112 that passes through all of the throttle bodies 108.

The valve shaft assembly 112 can be operable by the watercraft operator through a suitable mechanism including a throttle cable 114, a non-linear linkage 116, a control lever 118 and a bias spring 120. In the illustrated arrangement, the control lever 118 and the bias spring 120 generally are placed in a space 122 defined between the two upper intake passages 94 and the two lower intake passages 94. When the operator operates the throttle cable 114, the mechanism actuates the valve shaft assembly 112 to open the throttle valves 110. Conversely, when the throttle cable 114 is released, the mechanism actuates the valve shaft assembly 112 to close the throttle valves 110. Preferably, the spring 120 operates to close the valves when the opening force provided by the cable 114 is removed or reduced. A rapid closing of the throttle valve, as used herein, occurs when the valves are closed by the restorative force of the spring 120 without any opening biasing force provided by the throttle cable 114.

The throttle valves 110, thus, admit a proper amount of air into the intake passages 94 in proportion to an opening degree or opening position thereof. In other words, a certain amount of air measured by the throttle valves 110 is introduced into the combustion chambers 80 through the intake passages 94. Under a normal running condition, the larger the amount of the air, the higher the speed of the engine operation. When the throttle valves 110 are in a generally closed position, the opening degree at this position is defined as zero degrees. The throttle valves 110 preferably do not reach completely close, even in the zero position, and movement of the throttle valves 110 preferably stops at approximately one degree position so as to allow a small amount of air still flowing there. This amount of air can keep the engine operation in an idle state. In addition, small holes can be formed in the throttle valve 110 or a bypass passage can be arranged to allow a small level of air flow even if the throttle valves are completely closed.

The engine 54 also preferably includes an exhaust system that directs burnt air-fuel charges or exhaust gases to a location outside of the outboard motor 30. A set of exhaust ports 124 are defined in the cylinder head assembly 78 and are repeatedly opened and closed by a corresponding set of exhaust valves 126. When the exhaust ports 124 are opened, the combustion chambers 80 communicate with an exhaust manifold 128 which collects the exhaust gases and directs them away from the combustion chambers 80. The exhaust gases, in major part, are discharged into the body of water surrounding the outboard motor 30 through an exhaust passage 130 formed in an exhaust guide member, on which the engine 54 is mounted, an exhaust pipe 132 and an exhaust expansion chamber 134, which are formed in the driveshaft housing 50, and other internal passages formed in the lower unit 52.

An intake camshaft 138 and an exhaust camshaft 140 are journaled for rotation and extend generally vertically in the cylinder head assembly 78. The intake camshaft 138 actuates the intake valves 98 while the exhaust camshaft 140 actuates the exhaust valves 126. The camshafts 138, 140 have cam lobes 142 thereon to push the respective valves 98, 126. The associated ports 96, 124 are thus opened and closed repeatedly.

Preferably, the crankshaft 86 drives the camshafts 138, 140. Each camshaft 138, 140 has a sprocket 146, while the crankshaft 86 also has a sprocket 148. A timing belt or chain 150 is wound around the respective sprockets 146, 148. The crankshaft 86 therefore drives the camshafts 138, 140.

The illustrated engine 54 further includes a fuel injection system 154. The fuel injection system 154 preferably employs four fuel injectors 156 with one fuel injector allotted for each of the respective combustion chambers 80. Each fuel injector 156 has an injection nozzle that is exposed to the associated intake passage 94 such that the illustrated engine is indirectly injected. The injection nozzle preferably is opened and closed by an electromagnetic unit, such as a solenoid, which is slideable within an injection body. The electromagnetic unit generally comprises a solenoid coil, which is controlled by electrical signals. When the nozzle is opened, pressurized fuel is released from the fuel injectors 156. In the illustrated embodiment, the injection nozzle is directed toward the combustion chambers 80. Of course, in some arrangements, the fuel injectors can be disposed to inject fuel directly into the combustion chamber rather than indirectly into the combustion chamber through the induction passages. The illustrated fuel injectors 156 thus spray the fuel into the intake passages 94 during an open timing of the ports 96. The sprayed fuel enters the combustion chambers 80 with air that passes through the intake passages 94.

The fuel injection system 154 includes a fuel supply tank 160 that preferably is placed in the hull of the associated watercraft 38. In the illustrated arrangement, fuel is drawn from the fuel tank 160 by a first low pressure fuel pump 162 and a second low pressure pump 164 through a first fuel supply conduit 166. The first low pressure pump 162 preferably is a manually operated pump. The second low pressure pump 164 preferably is a diaphragm-type pump that can be operated by, for example, one of the intake and exhaust camshafts 138, 142. In this instance, the second low pressure pump 164 is mounted on the cylinder head assembly 78. A quick disconnect coupling can be provided in the first conduit 166. Also, a fuel filter 168 can be positioned in the conduit 166 at an appropriate location.

From the low pressure pump 164, fuel is supplied to a vapor separator 172 through a second fuel supply conduit 174. In the illustrated embodiment, the vapor separator 172 is mounted on the intake manifold 106. At the vapor separator end of the conduit 174, a float valve can be provided that is operated by a float 176 so as to maintain a substantially uniform level of the fuel contained in the vapor separator 172.

A high pressure fuel pump 178 is provided in the vapor separator 172. The high pressure fuel pump 178 pressurizes fuel that is delivered to the fuel injectors 156 through a delivery conduit 180. A fuel rail 182 defines a portion of the delivery conduit 180 and is mounted on the cylinder head assembly 78. The fuel rail 182 preferably supports the fuel injectors 156. The high pressure fuel pump 178 in the illustrated embodiment preferably comprises a positive displacement pump. The construction of the pump 178 thus generally inhibits fuel flow from its upstream side back into the vapor separator 172 when the pump 178 is not running. Although not illustrated, a back-flow prevention device (e.g., a check valve) also can be used to prevent a flow of fuel from the delivery conduit 180 back into the vapor separator 172 when the pump 178 is off. This later approach can be used with a fuel pump that employs a rotary impeller to inhibit a drop in pressure within the delivery conduit 180 when the pump 178 is intermittently stopped.

The high pressure fuel pump 178 is driven by a fuel pump drive motor 184 which, in the illustrated arrangement, is electrically operable and is unified with the pump 178 at its bottom portion. The drive motor 184 desirably is positioned in the vapor separator 172.

A pressure regulator 188 can be positioned along the fuel delivery conduit 180 at the vapor separator 172 and preferably limits the pressure that is delivered to the fuel injectors 156 by dumping the fuel back into the vapor separator 172.

A fuel return conduit 192 also is provided between the fuel injectors 156 and the vapor separator 126. Excess fuel that is not injected by the injector 156 returns to the vapor separator 126 through the return conduit 192.

A desired amount of the fuel is sprayed into the intake passages 94 through the injection nozzles at a selected timing for a selected duration. The injection timing and duration preferably are controlled by an ECU (electronic control unit) 194 through a control signal line 196. That is, the solenoid coil is supplied with electric power at the selected timing and for the selected duration. Because the pressure regulator 188 controls the fuel pressure, the duration can be used to determine a selected amount of fuel that will be supplied to the combustion chambers 80. Control strategies relating to the fuel injection system will be described in more detail below.

The engine 54 further includes an ignition or firing system. Each combustion chamber 80 is provided with a spark plug 200 that is connected to the ECU 194. The spark plug 200 is exposed into the associated combustion chamber 80 and ignites an air/fuel charge at a selected ignition timing. Although not shown, the ignition system preferably has an ignition coil and an igniter which are disposed between the spark plugs 200 and the ECU 194 so that an ignition timing also can be controlled by the ECU 194. In order to enhance or maintain engine performance, the ignition timing can be advanced or delayed in response to various engine running conditions. The ECU 194 and its operation will be described in greater detail below.

The ignition coil preferably is a combination of a primary coil element and a secondary coil element that are wound around a common core. Desirably, the secondary coil element is connected to the spark plugs 200 while the primary coil element is connected to the igniter. Also, the primary coil element is coupled with a power source and electrical current flows therethrough. The igniter abruptly cuts off the current flow in response to an ignition timing control signal and then a high voltage current flow occurs in the secondary coil element. The high voltage current flow forms a spark at each spark plug 200.

During engine operation, heat builds in, for example, the cylinder block 70 and the cylinder head assembly 78. Water jackets 204 thus are provided for cooling at least these portions 70, 78. Cooling water is introduced into the water jackets 204 by a water pump 206 from the body of water surrounding the outboard motor 30 and is returned to the body of water after circulating through the cooling jackets. Thus, the engine 54 employs an open loop type cooling system.

Figure 3:
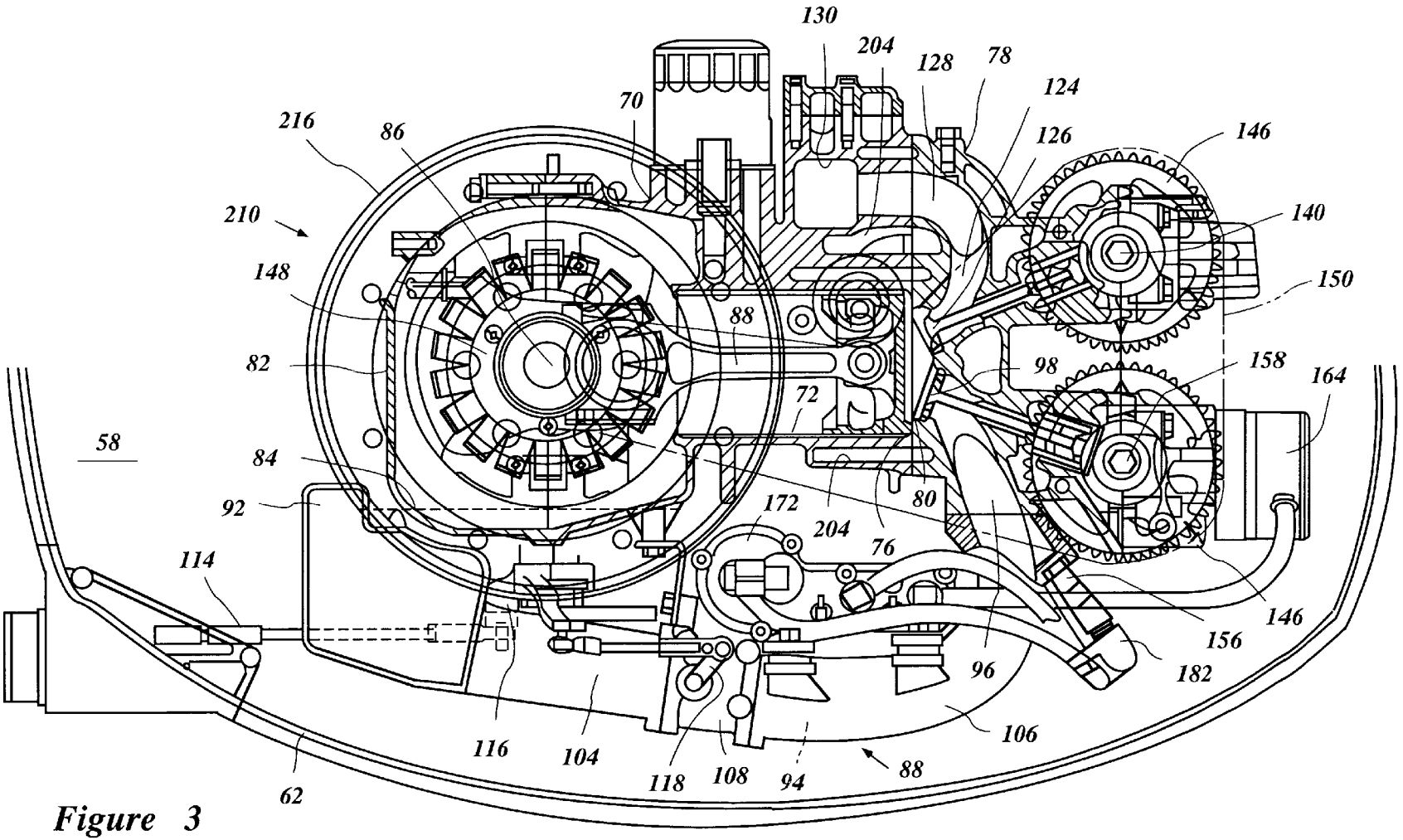
FIG. 3 is an enlarged top plan view of the power head. A top cowling member is detached and a starboard half of a bottom cowling is omitted. A simplified view of the engine also is shown in partial section.

In the illustrated arrangement, a flywheel assembly 210 is affixed atop the crankshaft 86. The flywheel assembly 210 preferably includes an AC generator or flywheel magneto that supplies electric power to electrical components including the fuel injection system 154 and the ignition system. A starter motor 212 is provided for driving the crankshaft 86 to start the engine 54. As seen in FIG. 3, the starter motor 212 has a gear portion 214 that meshes with a ring gear 216 of the flywheel assembly 210. When the engine 54 starts, the starter motor 212 drives the crankshaft 68 through the gear connection. Once the engine 54 starts, however, the starter motor 212 immediately ceases operation to reduce the likelihood that the starter mechanism will be damaged.

The AC generator generates AC power and the power preferably is sent to a battery 220 placed in the hull of the watercraft 38 through a rectifier-regulator. The rectifier-regulator converts the AC power to DC power and regulates current and voltage of the power. The DC power of the battery 220 preferably is supplied to the ECU 194 through a power supply line 222 via a main switch 224. The main switch 224 has, for example, a three-position switch mechanism. The power is preferably supplied to the ECU 194 at a first position, then to heavy load equipment such as an electric motor including the fuel pump drive motor 184 at a second position, and to the starter motor 212 at a third position. The main switch 224 can be operated by the watercraft operator and can be selectively turned to any one of the positions. Moving the switch to the third position, however, starts the engine 54. The switch mechanism forcibly moves to the second position from the third position once the engine 54 has started. The main switch 224 then preferably remains in the second position under normal running conditions of the engine 54.

Figure 4:
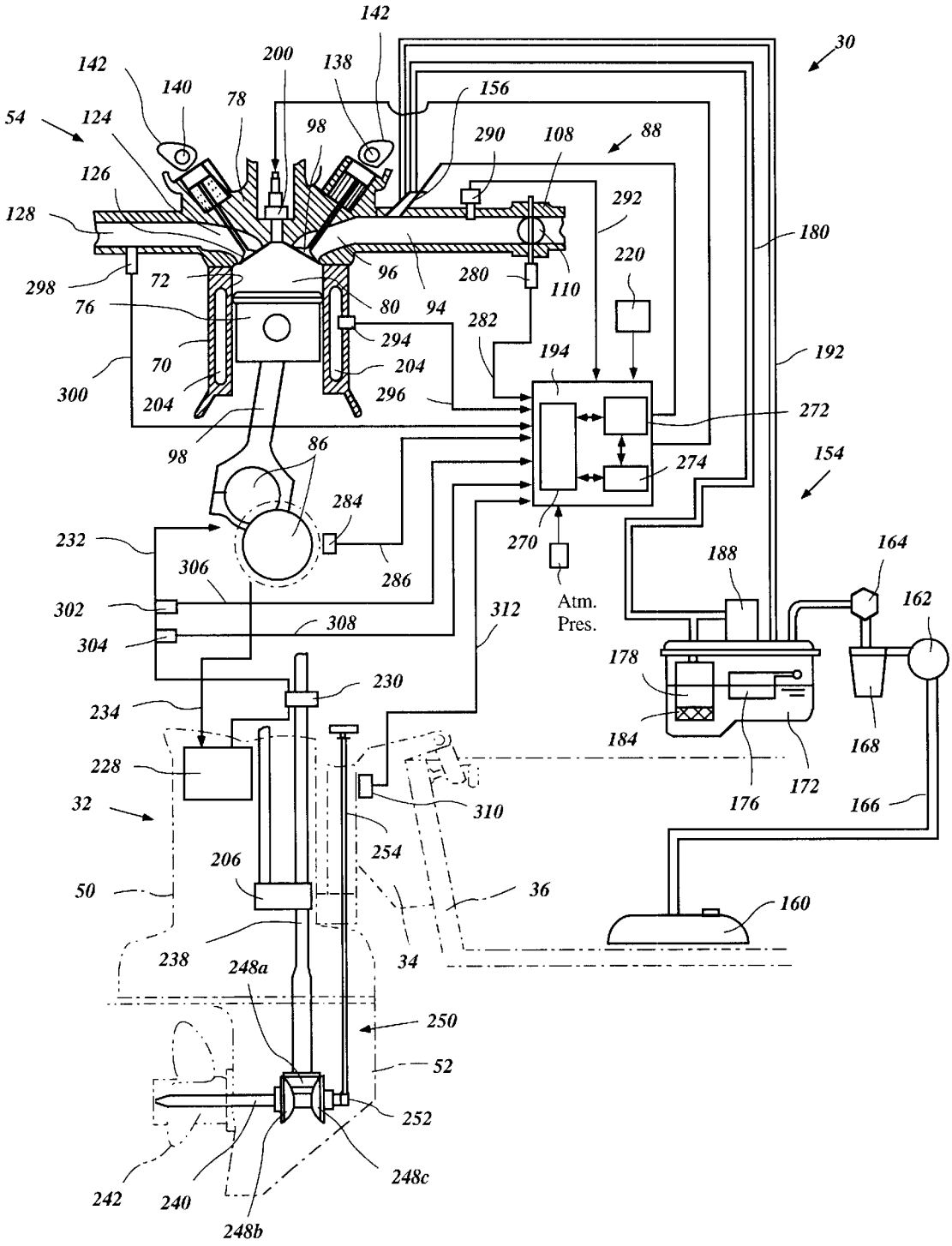
FIG. 4 is a schematic view of the outboard motor of FIG. 1. A portion of the engine is generally shown in the upper portion of the figure. A portion of the outboard motor including a driveshaft housing and a lower unit and the associated watercraft are shown in the lower portion of the figure. A control unit and a fuel injection system link together the two portions of the figure. The lower portion of the outboard motor and the watercraft are generally illustrated in phantom.

The engine 54 still further includes a lubrication system, which is rather schematically shown in FIG. 4, for lubricating certain portions of the engine 54 such as, for example, the interfaces between the connecting rods 88 and the crankshaft 86 and between the connecting rods 88 and the pistons 76. A lubricant reservoir 228 is disposed atop the driveshaft housing 50. Lubricant in the reservoir 228 is withdrawn by a lubricant pump 230 and then is delivered to the portions which need lubrication through a lubricant supply line 232. After lubricating the portions, the lubricant returns to the lubricant reservoir 228 through a lubricant return line 234 and which then repeats this circulation path. That is, the lubrication system preferably is formed as a closed loop.

The driveshaft housing 50 depends from the power head 48 and supports a driveshaft 238 which is driven by the crankshaft 86. The driveshaft 238 extends generally vertically through the driveshaft housing 50. The driveshaft 238 preferably drives the water pump 206 and the lubricant pump 230. As described above, the driveshaft housing 50 also defines internal passages which form portions of the exhaust system.

The lower unit 52 depends from the driveshaft housing 50 and supports a propulsion shaft 240, which is driven by the driveshaft 238. The propulsion shaft 240 extends generally horizontally through the lower unit 52. In the illustrated arrangement, the propulsion device is a propeller 242 that is affixed to an outer end of the propulsion shaft 240 and is driven thereby. The propulsion device, however, can take the form of a dual counter-rotating system, a hydrodynamic jet, or any of a number of other suitable propulsion devices.

A transmission 246 is provided between the driveshaft 238 and the propulsion shaft 240. The transmission 246 couples together the two shafts 238, 240 which lie generally normal to each other (i.e., at a 90° shaft angle) with bevel gears 248*a,* 248*b,* 248*c*. The outboard motor 30 has a switchover or clutch mechanism 250 that allows the transmission 246 to shift the rotational direction of the propeller 242 among forward, neutral or reverse.

In the illustrated arrangement, the switchover mechanism 250 includes a shift cam 252, a shift rod 254 and a shift cable 256. The shift rod 254 extends generally vertically through the driveshaft housing 50 and the lower unit 52. The shift cable 256 extends through the bottom cowling member 62 and then forwardly to a manipulator which is located next to a dashboard in the associated watercraft 38. The manipulator has a shift lever which is operable by the watercraft operator.

The lower unit 52 also defines an internal passage that forms a discharge section of the exhaust system, as discussed above. At engine speed above idle, the majority of the exhaust gases are discharged to the body of water surrounding the outboard motor 30 through the internal passage and finally through an outlet passage defined through the hub of the propeller 242. Of course, an above-the-water discharge can be provided for lower speed engine operation.

With reference now to FIG. 4, the ECU 194 preferably comprises a CPU (central processing unit) chip 270, memory or storage chips 272 and a timer or clock chip 274 which are electrically coupled together within a water-tight, hard box or container. The respective chips preferably are formed as an LSI (large scaled integrated circuit) and can be produced in a conventional manner. The timer chip 274 can be unified with the CPU chip. The memory chips 272 preferably includes ROM (read only memory), RAM (random access memory) and EEPROM (electrical erasable programmable ROM).

The ROM is a non-volatile memory and stores the most basic control programs that will not be erased by the watercraft operator. The programs include various control routines, such as those discussed below.

The RAM is a volatile memory and stores programs and data that are erasable and rewriteable. The RAM preferably stores at least one control map, which can be three-dimensional in some arrangements. The control map preferably has a horizontal axis designating throttle opening degrees (Km), a vertical axis designating engine speeds (Cn) and squares designating amounts of fuel (Amn) corresponding to both the throttle opening degrees and the engine speeds. The respective fuel amounts can be determined to provide an optimal air/fuel ratio in any combination of the throttle opening (Km) and the engine speed (Cn). Of course, less than optimal numbers can be used, where desired. The preferred RAM also can store an adjustment map that contains a relationship between atmospheric pressures and adjustment coefficients of fuel amounts. In the adjustment map, one atmospheric pressure corresponds to one adjustment coefficient. The higher the atmospheric pressure, the greater the specific gravity of air. The adjustment coefficients therefore become greater with increase of the atmospheric pressures. The RAM further stores an engine speed data that is used for determining whether the engine 54 has started. The ECU 194 preferably determines that the engine 54 has started when the engine speed reaches about 300 rpm.

The EEPROM is a non-volatile memory that the operator can erase programs and data stored therein, at least in part, and can rewrite them as he or she desires. In the illustrated arrangement, the EEPROM preferably stores an intake pressure as an atmospheric pressure at which the ECU 194 is been turned on while the engine 54 stands still. More specifically, when the main switch 224 is in the first or second position but the starter motor 212 has not yet operated, i.e., the main switch 224 has not turned onto the third position, then the EEPROM stores the sensed intake pressure as a proxy for atmospheric pressure.

As described above, the preferred ECU 194 stores a plurality of control maps or equations related to various control routines. In order to determine appropriate control indexes in the maps or to calculate them using equations based upon the control indexes determined in the maps, various sensors are provided for sensing engine conditions and other environmental conditions.

Figure 2:
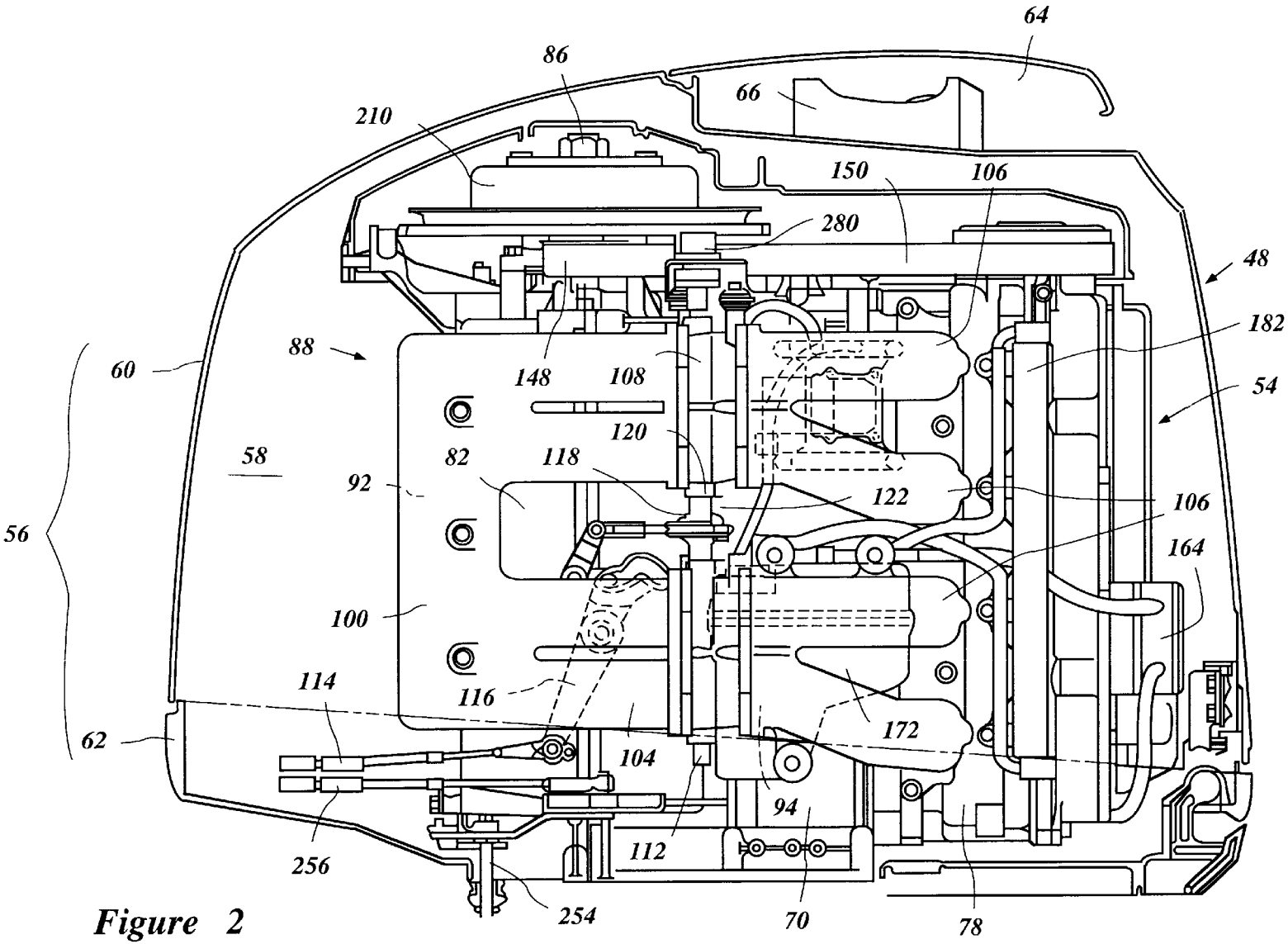
FIG. 2 is an enlarged side view of the power head. A protective cowling is shown in section.
Figure 5:
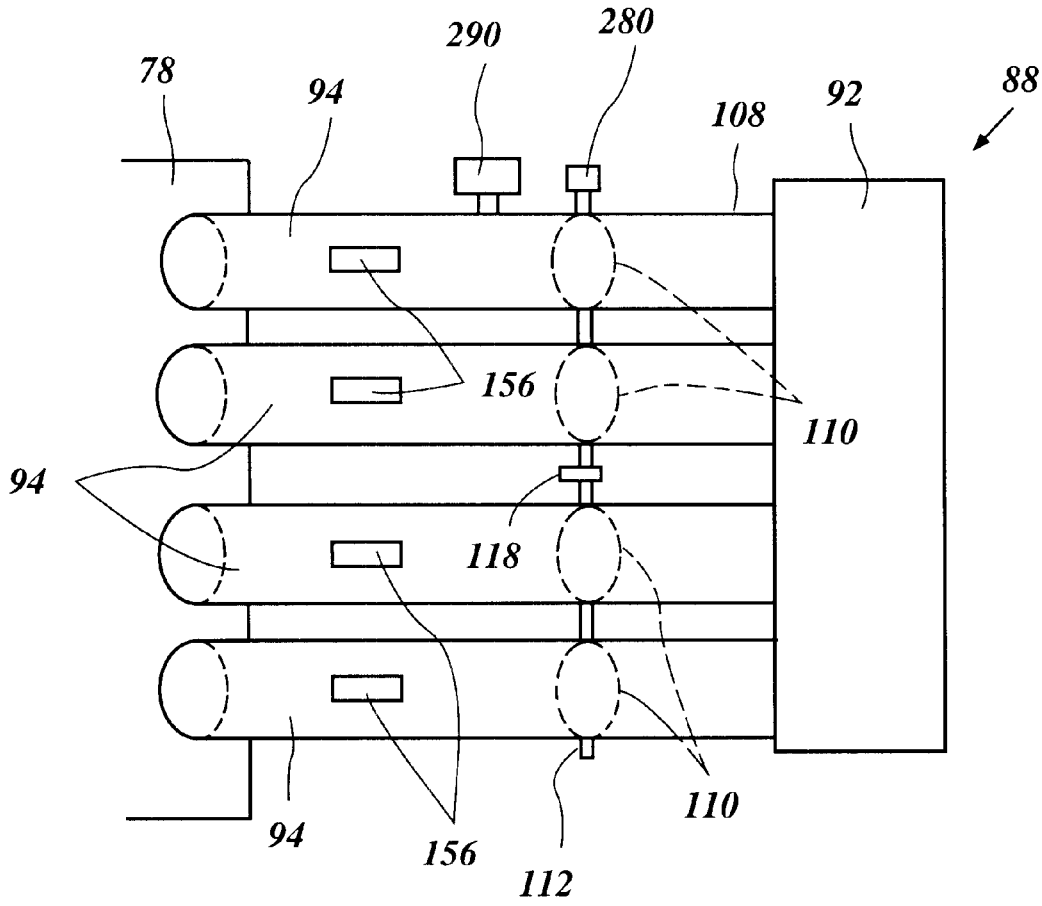
FIG. 5 is a schematic view of at least a portion of an air induction system that is associated with the engine of FIG. 1.

With primarily reference to FIG. 4 and additionally reference to FIGS. 2 and 5, a throttle valve position sensor 280 is provided proximate the valve shaft assembly 112 to sense an opening degree or opening position of the throttle valves 110. A sensed signal is sent to the ECU 194 through a sensor signal line 282. Of course, the signals can be sent through hard-wired connections, emitter and detector pairs, infrared radiation, radio waves or the like. The type of signal and the type of connection can be varied between sensors or the same type can be used with all sensors. The sensed signal also can be used to determine a rate of change of the throttle valve position.

Associated with the crankshaft 86 is a crankshaft angle position sensor 284 which, when measuring crankshaft angle versus time, outputs a crankshaft rotational speed signal or engine speed signal that is sent to the ECU 194 through a sensor signal line 286, for example. The sensor 284 preferably comprises a pulsar coil positioned adjacent to the crankshaft 86 and a projection or cut formed on the crankshaft 86. The pulsar coil generates a pulse when the projection or cut passes proximate the pulsar coil. The sensor 284 thus can sense not only a specific crankshaft angle but also a rotational speed of the crankshaft 86. Of course, other types of speed sensors also can be used.

An air intake pressure sensor 290 is positioned along one of the intake passages 94, preferably at the uppermost intake passage 94, at a location downstream of the throttle valve 110. The intake pressure sensor 290 primarily senses the intake pressure in this passages 94 during engine operation. The sensed signal is sent to the ECU 194 through a sensor signal line 292, for example. This signal can be used for determining engine load. In the illustrated arrangement, the sensor 290 also senses air pressure before the engine 54 starts. The sensed pressure can be a fairly accurate proxy for the atmospheric air pressure.

A water temperature sensor 294 at the water jacket 204 sends a cooling water temperature signal to the ECU 194 through a sensor signal line 296, for example. This signal represents engine temperature.

An oxygen ($O_2$) sensor 298 senses oxygen density in exhaust gases. The sensed signal is transmitted to the ECU 194 through a sensor signal line 300, for example. The signal represents air/fuel ratio and helps determine how complete combustion is within the combustion chambers.

The lubrication system has a lubricant temperature sensor 302 and a lubricant pressure sensor 304 at the lubricant supply line 232. The sensed signals are sent to the ECU 194 through a sensor signal line 306 and a sensor signal line 308, respectively, for example.

A shift position sensor 310 sends a signal indicating a position of the shift rod 254 (forward, neutral or reverse) to the ECU 194 through a sensor signal line 312, for example. A lever operational speed sensor 262 senses a rotational speed of the shift lever 202 and its signal is sent to the ECU 214 through a sensor signal line 264, for example. Of course, other suitable techniques for sensing transmission position and movement can be used.

With reference now to FIGS. 4 and 6–10, a control of the fuel injection system 154 by the ECU 194 will now be described below. Other controls and operations, which can be simultaneously practiced, will be omitted in this description. In addition, it should be recognized that the control system can be stored as software and executed by a general purpose controller, can be hardwired, or can be executed by a devoted controller.

As mentioned above, due to the environment in which outboard motors operate, there are some operating conditions that are unique to outboard motors. In particular, when the operator releases the throttle valve actuator, the throttle valve 110 rapidly closes (i.e., the throttle valve closes under the biasing force of a spring, as the opening force provided by the operator controlled actuator is removed). In an outboard motor that is in forward or reverse drive motion, the advancing force of the watercraft tends to drive the propeller 242, which, in turn, drives the engine. That is, the water surrounding the propeller 242 rotates the propeller 242 , which, in turn, rotates the crankshaft 86. The engine speed, therefore, does not decrease as rapidly as desired.

Figure 6:
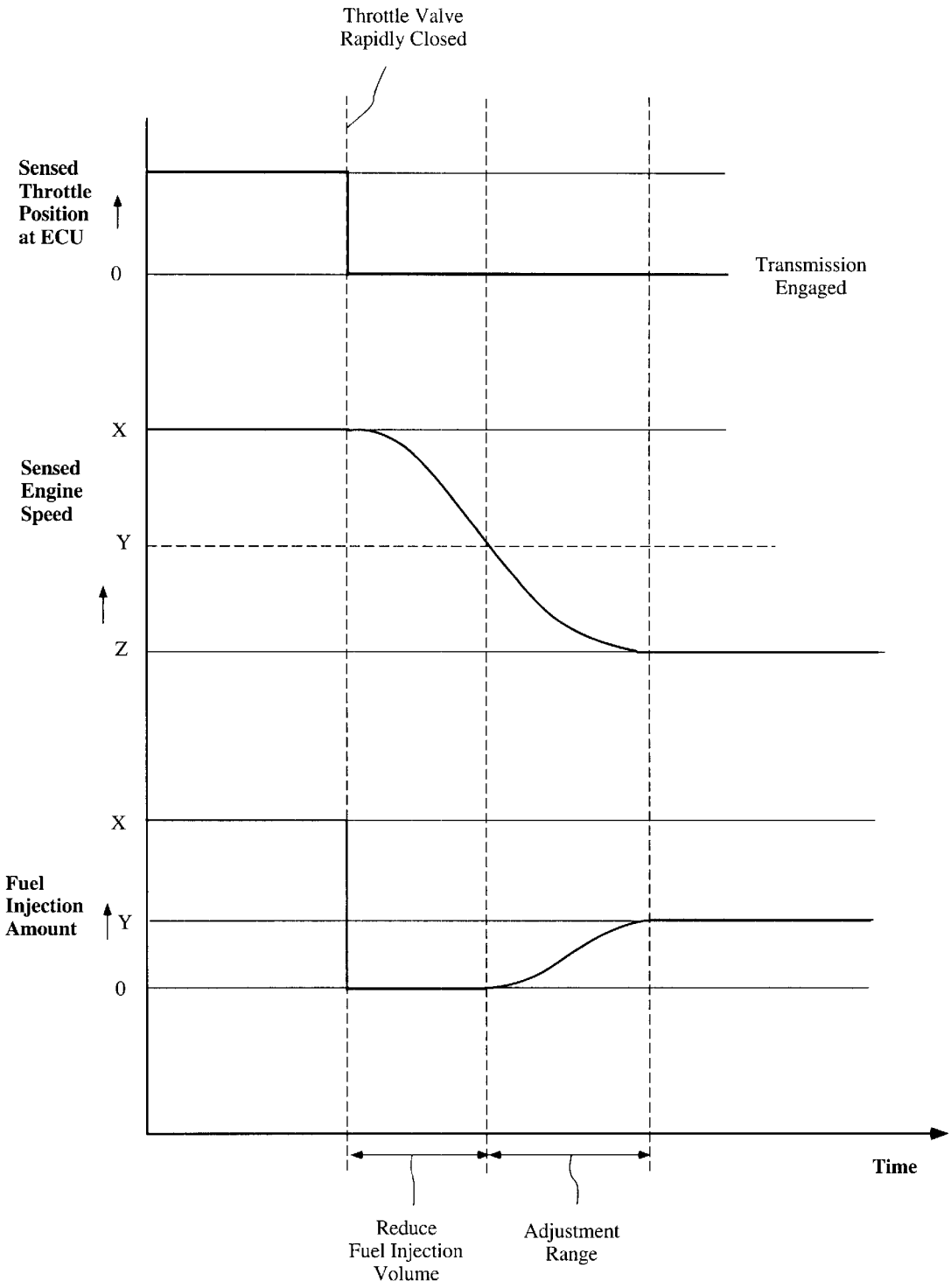
FIG. 6 is a graphical illustration of the operational states of a throttle valve, the engine speed and at least one fuel injector over time when the outboard motor is in a forward or reverse drive condition and being operated according to certain features and aspects of the present invention.
Figure 7:
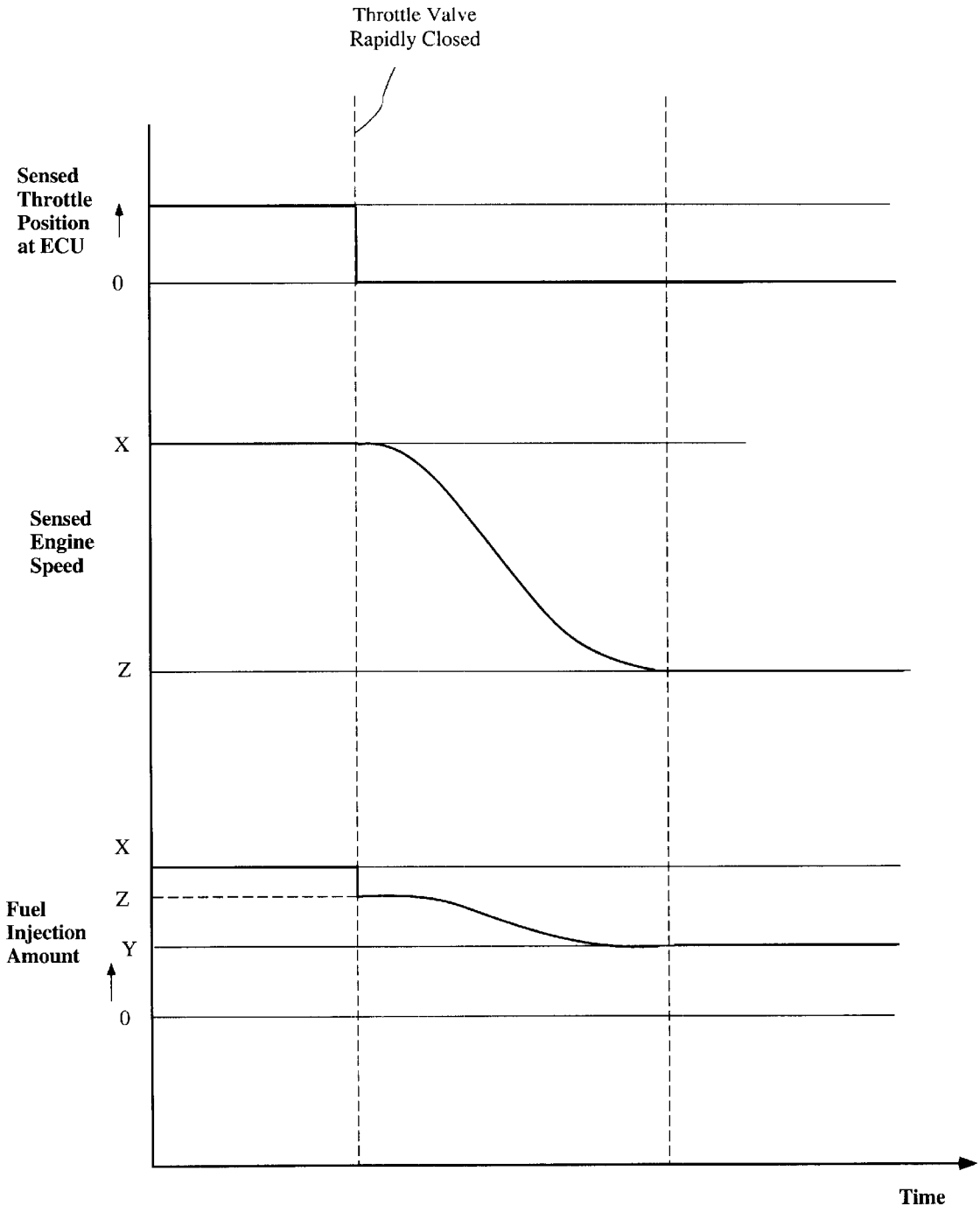
FIG. 7 is a graphical illustration of the operational states of the throttle valve, the engine speed and at least one fuel injector over time when the outboard motor is in a neutral drive condition and being operated according to certain features and aspects of the present invention.

Accordingly, the illustrated fuel injection system 154 includes a control arrangement having certain features, aspects and advantages of the present invention and which is graphically illustrated in FIGS. 6 and 7. More specifically, FIG. 6 illustrates the amount of fuel injected (i.e., fuel injection amount) when the throttle valve 110 is rapidly closed and the transmission 246 is engaged in either forward or reverse drive. By rapidly closed, it is intended to mean that the biasing force holding open the throttle valve 110 is removed or that the throttle valve 110 is returned to a closed position under the control of a return spring rather than being slowly released under operator control. This is meant to differentiate between a controlled throttle angle decrease, such as when the operator slowly decreases the throttle angle, and a rapid throttle angle decrease, wherein the operator simply releases the actuator member controlling the throttle valve. In a similar manner, FIG. 7 illustrates the fuel injection amount when the throttle valve 110 is rapidly closed and the transmission 246 is disengaged or in neutral.

As shown in FIG. 6, when the transmission 246 is engaged in either forward or reverse and the throttle valve angle rapidly decreases, the fuel injection amount preferably is reduced substantially from its previous value X. More preferably, the fuel injection amount is reduced to substantially zero. In this manner, the engine 54 is turned off and the engine speed decreases more rapidly because the engine is not providing any power input. As the engine speed slows, the engine speed eventually reaches a predetermined value Y and the fuel injection amount then is gradually increased as the engine speed slows from the targeted value X to a preset or idling speed Z (preferably about 600 RPM). Most preferably, when the engine speed reaches the preset or idling speed Z the fuel injection amount has been adjusted to a value Y that is approximately equal to the amount of fuel that would be injected at the preset or idle speed Z during normal conditions (i.e., without a rapid decrease in the throttle valve angle). The predetermined engine speed Y preferably is approximately equal to a minimum engine speed at which the engine will not stall if the fuel injection amount has been reduced to substantially zero.

As mentioned above, when the outboard motor is disengaged or in neutral, the propeller does not drive the engine when the throttle valve is closed rapidly. Accordingly, if the fuel injection amount is decreased too much, the engine can stall. Thus, a control arrangement such as that illustrated in FIG. 7 can be used when the transmission 246 is disengaged or in neutral and the throttle valve 110 is rapidly closed. In this arrangement, when the throttle valve angle rapidly decreases, the fuel injection amount preferably is reduced to an amount Z that is less than the previous value X. However, this fuel injection amount Z preferably is greater than the amount of fuel injected into the engine when the engine is in forward or reverse. After the fuel injection amount is initially reduced, the fuel injection amount is gradually decreased as the engine slows to a preset or idling speed Z (preferably about 600 RPM). More preferably, when the engine speed reaches the preset or idling speed Z, the fuel injection amount has been adjusted to a value Y that is approximately equal to the amount of fuel that would be injected at the preset or idling speed under normal conditions (i.e., without a rapid decrease in the throttle valve angle).

Figure 8:
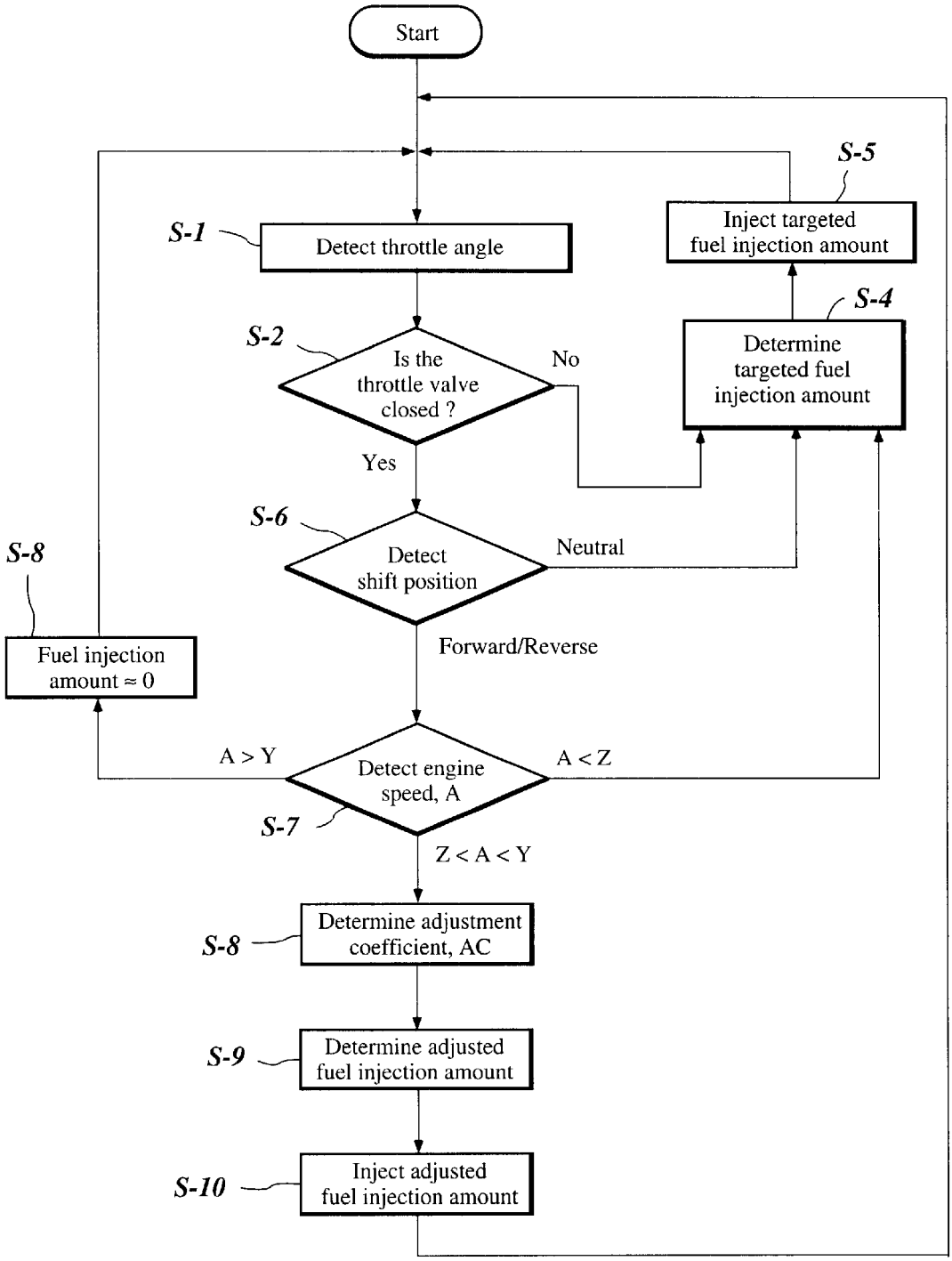
FIG. 8 is a flow diagram illustrating a control routine having certain features and advantages according to the present invention.
Figure 9:
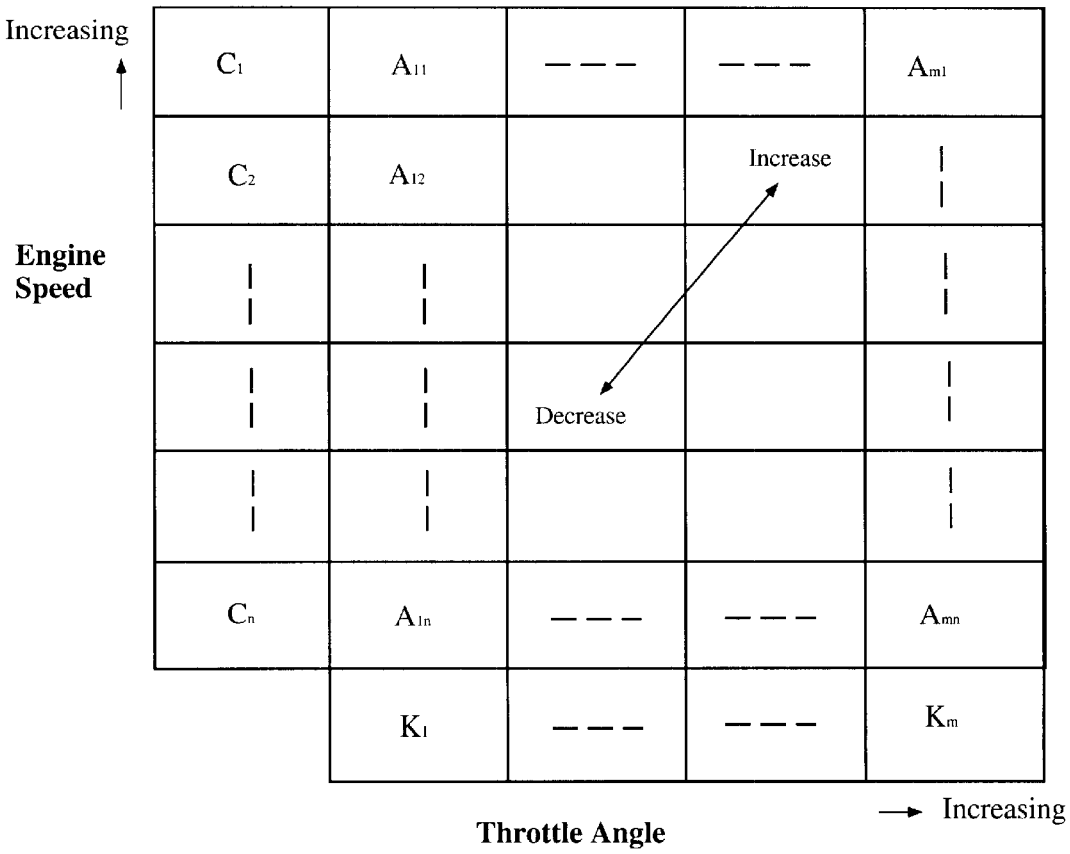
FIG. 9 is a fuel injection control map that can be used with the control routine of FIG. 8.
Figure 10:
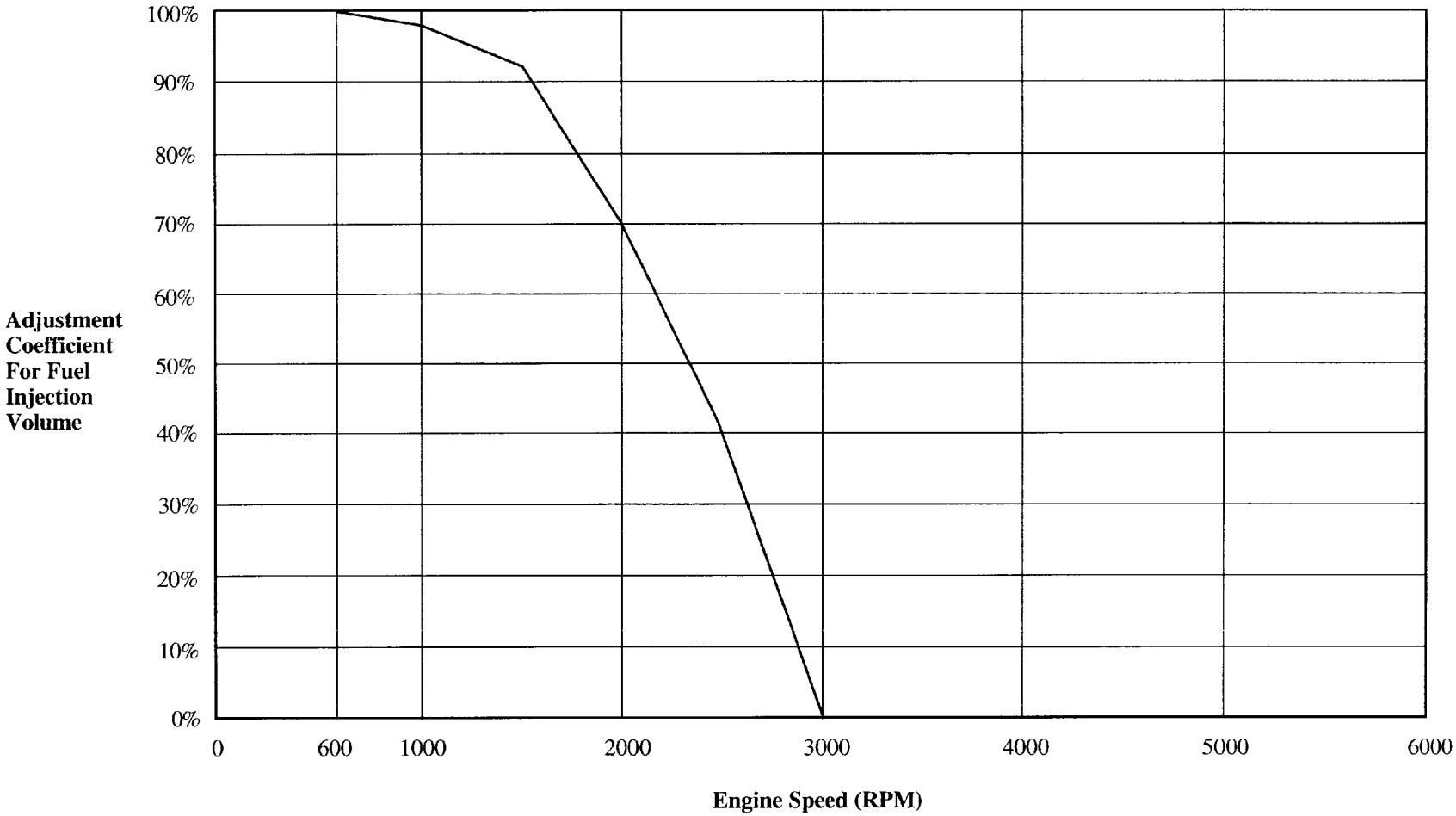
FIG. 10 is a graphical illustration of another control map that can be used with the control routine of FIG. 8.

With reference now to FIG. 8, a control routine that is capable of implementing a control strategy that achieves control similar to that described graphically in FIGS. 6 and 7 is illustrated therein. With reference now to FIG. 8, the routine begins by detecting a throttle angle (see S-1). Preferably, this is done by analyzing the signal provided by the throttle valve position sensor 280. After the throttle angle has been detected, the control routines determines if the throttle valve is closed (see S-2). If the throttle valve 110 is not closed, a targeted fuel injection amount is determined as indicated by operational block S-4. Preferably, the targeted fuel injection amount is determined by utilizing a control map such as the one illustrated in FIG. 9. The illustrated control map provides the targeted fuel amount as a function of engine speed and throttle valve angle. Accordingly, the target fuel injection amount can be determined from the signals sent by the crankshaft angle position sensor 284 and the signal from the throttle valve position sensor 280. It should be appreciated that, in a modified arrangement, the control routine can be configured (i) to detect the rate that the throttle valve closes and (ii) to determine if the detected rate is greater than a predetermined value. If the detected rate is not greater than the predetermined value, the control routine can proceed to the operational block S-4 and S-5 as described above.

If the throttle valve 110 is closed, the controller senses the positioning of the transmission (see S-6). In the illustrated arrangement, this is performed by detecting a signal that is being emitted from the shift sensor 310. Of course, other manners of detecting this may be used. If the transmission is disengaged (i.e., in neutral), the targeted fuel injection amount is determined and the targeted fuel injection amount is injected into the engine as described above with respect to operational blocks S-4 and S-5. If the transmission is engaged (i.e., in forward or reverse), the controller determines the engine speed A (see S-7).

If the engine speed A is less than a first predetermined value Z, the targeted fuel injection amount is determined and the targeted fuel injection amount is injected into the engine as described above with respect to operational blocks S-4 and S-5. Preferably, the first predetermined value Z is approximately equal to the idling speed of the engine, which is typically about 600 RPM. If the engine speed A is greater than a second predetermined value Y, the fuel injection amount is reduced substantially as indicated by operational block S-8. Preferably, the fuel injection amount is reduced to substantially zero. As mentioned above, the second predetermined value Y preferably is approximately equal to the minimum engine speed at which the engine will not stall if the fuel injection amount is reduced to substantially zero. After the fuel injection amount is reduced, the control routine preferably loops back to operational block S-1.

If the engine speed A is between the first and second predetermined values Z, Y, the control routine slowly increases the fuel injection amount as indicated by operational blocks S-8, S-9, and S-10. Specifically, as indicated by operational block S-8, the control routine determines an adjustment coefficient, AC. In the illustrated arrangement, the adjustment coefficient is determined by referencing a control map such as the one illustrated in FIG. 10. As shown, the adjustment coefficient is a function of engine speed. At an engine speed that is approximately equal to the second predetermined value Y, the adjustment coefficient is equal to about 0%. At an engine speed approximately equal to the first predetermined value Z, the adjustment coefficient is equal to about 100%. Preferably, as the engine speed slows down from the second predetermined value Y to the first predetermined value Z, the adjustment coefficient gradually changes from 0% to 100%. After the adjustment coefficient is determined, an adjusted fuel injection amount is determined (see S-9). In the illustrated arrangement, this is determined by multiplying the adjustment coefficient AC by the targeted fuel injection amount as determined, in the illustrated arrangement, from the control map of FIG. 9. After the adjusted fuel injection amount is determined, the adjusted fuel injection amount is injected into the engine (see S-10) and the control routine preferably loops back to operational block S-1. Accordingly, as shown in FIG. 6, the fuel injection amount is gradually increased as the engine speed slows from the second predetermined value Y to the first predetermined value Z.

Accordingly, the present invention provides a control routine that substantially reduces the fuel injection amount when the throttle control valve is rapidly closed and the transmission is in forward or reverse drive. Moreover, when the engine speed decreases past a predetermined value, the fuel injection amount is gradually increased until the engine reaches an idling speed. When the engine is in neutral, the fuel injection amount is initially reduced. However, as compared to when the engine is in forward or reverse, the fuel injection amount is larger. The fuel injection amount is then decreased as the engine slows down. Accordingly, in this arrangement, the engine speed decreases more rapidly when the engine is in forward or reverse and does not stall when the engine is in neutral.

Although the present invention has been described in terms of certain preferred embodiments, other embodiments apparent to those of ordinary skill in the art also are within the scope of this invention. Thus, various changes and modifications may be made without departing from the spirit and scope of the invention. For instance, various components may be repositioned as desired and certain steps of the control routine can be combined, subdivided or interlaced with other operations. Moreover, not all of the features, aspects and advantages are necessarily required to practice the present invention. Accordingly, the scope of the present invention is intended to be defined only by the claims that follow.

What is claimed is:

1. A method of controlling an amount of fuel injected into an engine when a throttle valve is rapidly closed, the method comprising detecting a throttle valve angle, deter ining if the valve is substantially closed, determining whether a transmission of the engine is engaged or disengaged, sensing the engine speed and comparing the engine speed to a first specified value, reducing an amount of fuel injected into the engine by a first amount if the engine speed is greater than the second specified value and the transmission is engaged, reducing the amount of fuel injected into the engine by a second amount if the transmission is disengaged, wherein the first specified value is approximately 3000 RPM.

2. A method of controlling an amount of fuel injected into an engine when a throttle valve is rapidly closed, the method comprising, detecting a throttle valve angle, determining if a transmission of the engine is in a first condition or a second condition, and sensing an engine speed, wherein in the first condition the transmission is engaged and the first predetermined value is 3000 RPM.

3. An engine for a watercraft comprising a cylinder body, at least one cylinder bore being formed in said cylinder body, a piston being mounted for reciprocation within said cylinder bore, a cylinder head being disposed over a first end of said cylinder bore, a crankcase member being disposed over a second end of said cylinder bore, an output shaft being disposed at least partially within a crankcase chamber at least partially defined by said crankcase member, said output shaft powering an output device through a shiftable transmission, a transmission sensor being capable of detecting whether said output device is engaged or disengaged with the output shaft, a combustion chamber being defined at least partially within said cylinder bore between said cylinder head and said piston, an intake conduit communicating with said combustion chamber, a throttle valve being disposed within said intake conduit, a throttle valve sensor being capable of sensing a position of said throttle valve, a fuel injection system including a fuel injector that supplies fuel to the combustion chamber, the fuel injector including an actuator to regulate an amount fuel injected by the fuel injector, a controller electrically communicating with the actuator for the fuel injector, the transmission sensor and the throttle valve sensor, the controller being adapted to substantially reduce the amount of fuel injected by the fuel injector to a second amount of fuel when the throttle valve is rapidly closed and the output device is engaged.

4. The engine of claim 3, wherein the second amount of fuel is substantially zero.

5. The engine of claim 3, wherein the second amount of fuel is zero.

6. The engine of claim 3, wherein the controller is further adapted such that, when the output device is disengaged and the throttle valve is rapidly closed, the amount of fuel injected by the injector is reduced to a third amount of fuel which is greater than the second amount of fuel.

7. The engine of claim 6, wherein the controller is further configured such that when the output device is disengaged, the amount of fuel injected is decreased from third amount of fuel until the engine reaches an idling speed.

8. The engine of claim 3, wherein, after the amount of fuel is substantially reduced and the engine reaches a first predetermined engine speed, the controller increases the amount of fuel injected.

9. The engine of claim 8, wherein the first predetermined value is approximately 3000 RPM.

10. The engine of claim 8, wherein the controller increases the amount of fuel injected until the engine reaches an idling speed.

11. An engine for a watercraft comprising a cylinder body, at least one cylinder bore being formed in said cylinder body, a piston being mounted for reciprocation within said cylinder bore, a cylinder head being disposed over a first end of said cylinder bore, a crankcase member being disposed over a second end of said cylinder bore, an output shaft being disposed at least partially within a crankcase chamber at least partially defined by said crankcase member, said output shaft powering an output device through a shiftable transmission, a transmission sensor being capable of detecting whether said output device is engaged or disengaged, a combustion chamber being defined at least partially within said cylinder bore between said cylinder head and said piston, an intake conduit communicating with said combustion chamber, a throttle valve being disposed within said intake conduit, a throttle valve sensor being capable of sensing a position of said throttle valve, a fuel injection system including a fuel injector that supplies fuel to the combustion chamber, the fuel injector including an actuator to regulate an amount fuel injected by the fuel injector, a controller electrically communicating with the actuator for the fuel injector, the transmission sensor and the throttle valve sensor, the controller being adapted to reduce the amount of fuel injected by the fuel injector to a first amount when the throttle valve is rapidly closed and the output device is engaged and to reduce the amount of fuel injected by the fuel injector to a second amount when the output device is disengaged.

12. The engine of claim 11, wherein said first amount is substantially smaller than said second amount.

13. The engine of claim 11, wherein the first amount of fuel is substantially zero.

14. The engine of claim 11, wherein the first amount of fuel is zero.

15. The engine of claim 11, wherein when the output device is engaged and after the amount of fuel injected is reduced to the first amount, the controller increases the amount of fuel injected after the engine reaches a first predetermined engine speed.

16. The engine of claim 15, wherein the first predetermined engine speed is approximately 3000 RPM.

17. The engine of claim 15, wherein the controller increases the amount of fuel injected until the engine reaches an idling speed.

18. The engine of claim 15, wherein the controller is further configured such that, when the output device is disengaged and after the amount of fuel is reduced to the second amount, the amount of fuel injected is further decreased until the engine reaches an idling speed.

19. A method of controlling an amount of fuel injected into an engine of an outboard motor when a throttle valve is rapidly closed, the method comprising detecting a throttle valve angle, determining if the valve is substantially closed, determining whether a transmission of the engine is engaged or disengaged, sensing the engine speed and comparing the engine speed to a first specified value, reducing an amount of fuel injected into the engine by a first amount if the engine speed is greater than the first specified value and the transmission is engaged, reducing the amount of fuel injected into the engine by a second amount if the transmission is disengaged.

20. The method of claim 19, wherein the second amount is less than the first amount.

21. The method of claim 19, further comprising, increasing the amount of fuel injected into the engine when the transmission is engaged and after the amount of fuel injected has been reduced the first amount.

22. The method of claim 19, further comprising, further decreasing the amount of fuel injected into the engine when the transmission is disengaged and after the amount of fuel injected has been reduced the second amount.

23. A method of controlling an amount of fuel injected into an engine of an outboard motor when a throttle valve is rapidly closed, the method comprising, detecting a throttle valve angle, determining if a transmission of the engine is in a first condition or a second condition, and sensing an engine speed.

24. The method of claim 23, further comprising reducing the amount of fuel being injected into the engine to a second amount if the transmission is in a first condition and the sensed engine speed is above a first predetermined value.

25. The method of claim 24, wherein the second amount is substantially zero.

26. The method of claim 24, wherein in the second the transmission is engaged.

27. The method of claim 24, further comprising reducing the amount of fuel being injected into the engine to a third amount if the transmission is in a second condition.

28. The method of claim 27, wherein the third amount is greater than the second amount.

* * * * *

UNITED STATES PATENT AND TRADEMARK OFFICE

CERTIFICATE OF CORRECTION

PATENT NO. : 6,526,946 B1
DATED : March 4, 2003
INVENTOR(S) : Kanno, Isao

It is certified that error appears in the above-identified patent and that said Letters Patent is hereby corrected as shown below:

Title page,
Item [73], Assignee, change "Shansin" to -- Sanshin --.
Item [56], References Cited, OTHER PUBLICATIONS, Serial No. 09/704,015 reference, change "Co-pendgin" to -- Co-pending --.

Signed and Sealed this

Twenty-sixth Day of August, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,526,946 B1
DATED : March 4, 2003
INVENTOR(S) : Isao Kanno

It is certified that error appears in the above-identified patent and that said Letters Patent is hereby corrected as shown below:

Column 14,
Line 53, change “deter ining” to -- determining --.

Signed and Sealed this

Sixth Day of July, 2004

JON W. DUDAS
*Acting Director of the United States Patent and Trademark Office*